US006823163B2

(12) United States Patent
Sugimoto et al.

(10) Patent No.: US 6,823,163 B2
(45) Date of Patent: Nov. 23, 2004

(54) IMAGE FORMING APPARATUS INCLUDING AN ELECTRIC FIELD HAVING AN OSCILLATION COMPONENT BETWEEN AN IMAGE CARRIER AND A DEVELOPER CARRIER

(75) Inventors: Naomi Sugimoto, Kanagawa (JP); Tsukuru Kai, Kanagawa (JP); Hisashi Shoji, Kanagawa (JP); Nobutaka Takeuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 20 days.

(21) Appl. No.: 09/864,335

(22) Filed: May 25, 2001

(65) Prior Publication Data

US 2002/0009312 A1 Jan. 24, 2002

(30) Foreign Application Priority Data

May 26, 2000 (JP) ..... 2000-156711
Jun. 29, 2000 (JP) ..... 2000-196578

(51) Int. Cl.[7] ..... G03G 15/09
(52) U.S. Cl. ..... 399/270; 399/267; 399/277
(58) Field of Search ..... 399/267, 270, 399/274, 277; 430/122

(56) References Cited

U.S. PATENT DOCUMENTS 4,825,241 A * 4/1989 Saijo et al. ..... 399/275
5,937,228 A * 8/1999 Shoji et al. ..... 399/270
5,991,586 A * 11/1999 Nagao ..... 399/274
6,295,437 B1 9/2001 Hodoshima et al.
6,366,751 B1 4/2002 Shakuto et al.
6,385,423 B1 5/2002 Kai
6,449,452 B1 9/2002 Kai
6,456,806 B2 * 9/2002 Shoji et al. ..... 399/277

FOREIGN PATENT DOCUMENTS

JP 8-36303 A 2/1996
JP 10-39620 2/1998
JP 2941884 B2 6/1999
JP 2000-305360 11/2000

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus develops a latent image formed on an image carrier with a developer that forms a magnet brush on a developer carrier. The developer carrier is made up of a sleeve and a stationary magnet roller accommodated in the sleeve. The magnet roller includes a main pole for causing the developer to form the magnet brush and auxiliary poles for helping the main pole exert a magnetic force. An electric field including an oscillation component is formed between the image carrier and the developer carrier. A particular ratio is set up between a distance between the image carrier and the developer carrier, as measured at the boundary of a nip, and the shortest distance between them, between the above shortest distance and the shortest distance between the developer carrier and a metering member, or between the shortest distance between the image carrier and the developer carrier and the amount of developer scooped up to the image carrier.

8 Claims, 16 Drawing Sheets

*Fig. 11*

| No. | 1 | 2 | 3 | 4 | 5 | 6 | 7 | 8 | 9 | 10 |
|---|---|---|---|---|---|---|---|---|---|---|
| COPIER | MONOCHROMATIC COPIER | | | | COLOR COPIER | | | | | |
| SLEEVE VELOCITY/ DRUM VELOCITY | 2.5 | | 2.5 | | 1.3 | | | | | |
| DRUM DIAMETER (mm) | 30 | | 60 | | 90 | | | | | |
| SLEEVE DIAMETER (mm) | 16 | | 20 | | 30 | | | | | |
| DEVELOPMENT GAP (mm) | 0.4 | | | | 0.4 | | | | 0.35 | |
| NIP (mm) | 4 | 1.5 | 4 | 2 | 7 | 7 | 4 | 4 | 1.5 | 1.5 |
| DISTANCE AT NIP BOUNDARY (mm) | 0.79 | 0.45 | 0.67 | 0.47 | 0.95 | 0.95 | 0.58 | 0.58 | 0.42 | 0.42 |
| BOUNDARY DISTANCE/ NIP DISTANCE | 1.67 | 1.17 | 2.38 | 1.45 | 1.97 | 1.97 | 1.13 | 1.13 | 1.2 | 1.2 |
| BIAS | DC −600V ONLY | | | | ※1 | ※2 | ※1 | ※2 | ※1 | ※2 |
| OMISSION RANK | 2.5 | 4.5 | 2.5 | 4.5 | 3 | 3 | 4.5 | 4.5 | 4.5 | 4.5 |
| GRANULARITY RANK | 2 | 2 | 2 | 2 | 3 | 2 | 4.5 | 2 | 4.5 | 2 |

※1 DC+AC, f5kHz, DUTY 25%, OFFSET VOLTAGE−700V, PEAK VOLTAGE 800V
※2 DC−500V ONLY

Fig. 12

| FREQUENCY(kHz) | GRANULARITY RANK |
|---|---|
| 0 | 2 |
| 0.5 | 3 |
| 1 | 3.75 |
| 2 | 4 |
| 2.25 | 4 |
| 2.5 | 4.25 |
| 3 | 4.5 |
| 3.5 | 4.5 |
| 4 | 4.75 |
| 4.5 | 4.5 |
| 5 | 4.5 |
| 5.5 | 4.5 |
| 6 | 4.5 |
| 7 | 4.5 |
| 9 | 4.5 |

Fig. 13

| DUTY (%) | GRANULARITY RANK |
|---|---|
| 10 | 4.75 |
| 15 | 4.75 |
| 20 | 4.75 |
| 25 | 4.75 |
| 30 | 4.75 |
| 35 | 4.75 |
| 40 | 4.75 |
| 45 | 4.25 |
| 50 | 4 |
| 60 | 3.5 |

*Fig. 14*

| Gp[mm] | Gd[mm] | Gp/Gd | BIAS: DC-500V | | BIAS: AC f4.5kHz Vpp 800V DUTY 50% | |
|---|---|---|---|---|---|---|
| | | | GRANULARITY RANK | OMISSION RANK | GRANULARITY RANK | OMISSION RANK |
| 0.35 | 0.75 | 0.466667 | 1.5 | 4 | 4.5 | 4 |
| 0.43 | 0.83 | 0.518072 | 1.5 | 4 | 4.5 | 4 |
| 0.35 | 0.63 | 0.555556 | 1.5 | 4 | 4 | 4 |
| 0.43 | 0.75 | 0.573333 | 1.5 | 4 | 4 | 4 |
| 0.5 | 0.83 | 0.60241 | 1.5 | 4 | 4 | 4 |
| 0.5 | 0.75 | 0.666667 | 1.5 | 4 | 4 | 4 |
| 0.35 | 0.52 | 0.673077 | 1 | 4 | 3.5 | 4 |
| 0.43 | 0.63 | 0.68254 | 1 | 4 | 3.5 | 4 |
| 0.43 | 0.52 | 0.826923 | 1 | 4 | 3 | 4 |
| 0.6 | 0.52 | 1.153846 | 1 | 4 | 2 | 4 |

*Fig. 15*

| Gp[mm] | Gd[mm] | Gp/Gd | BIAS : DC−500V | | BIAS : AC f4.5kHz Vpp 800V DUTY 50% | |
|---|---|---|---|---|---|---|
| | | | GRANULARITY RANK | OMISSION RANK | GRANULARITY RANK | OMISSION RANK |
| 0.35 | 0.75 | 0.466667 | 1 | 2 | 3.5 | 2 |
| 0.35 | 0.64 | 0.546875 | 1 | 2 | 3.5 | 2 |
| 0.4 | 0.64 | 0.625 | 1 | 2 | 3.5 | 2 |
| 0.45 | 0.56 | 0.803571 | 1 | 2 | 3.5 | 2 |
| 0.5 | 0.56 | 0.892857 | 1 | 2.5 | 3.5 | 2.5 |
| 0.6 | 0.85 | 0.705882 | 1 | 2.75 | 2 | 2.75 |
| 0.6 | 0.91 | 0.659341 | 1 | 2.75 | 2 | 2.75 |

Fig. 16

| Gp[mm] | ρ [g/cm²] | Gp/ρ | BIAS : DC-500V | | BIAS : AC f4.5kHz Vpp 800V DUTY 50% | |
|---|---|---|---|---|---|---|
| | | | GRANULARITY RANK | OMISSION RANK | GRANULARITY RANK | OMISSION RANK |
| 0.35 | 0.065 | 5.384615 | 1.5 | 4 | 4.5 | 4 |
| 0.43 | 0.08 | 5.375 | 1.5 | 4 | 4.5 | 4 |
| 0.35 | 0.05 | 7 | 1.5 | 4 | 4 | 4 |
| 0.43 | 0.065 | 6.615385 | 1.5 | 4 | 4 | 4 |
| 0.5 | 0.08 | 6.25 | 1.5 | 4 | 4 | 4 |
| 0.5 | 0.065 | 7.692308 | 1.5 | 4 | 4 | 4 |
| 0.35 | 0.035 | 10 | 1 | 4 | 3.5 | 4 |
| 0.43 | 0.05 | 8.6 | 1 | 4 | 3.5 | 4 |
| 0.43 | 0.036 | 11.94444 | 1 | 4 | 3 | 4 |
| 0.6 | 0.035 | 17.14286 | 1 | 4 | 2 | 4 |

*Fig. 17*

| Gp[mm] | $\rho$ [g/cm$^2$] | Gp/$\rho$ | BIAS : DC−500V | | BIAS : AC f4.5kHz Vpp 800V DUTY 50% | |
|---|---|---|---|---|---|---|
| | | | GRANULARITY RANK | OMISSION RANK | GRANULARITY RANK | OMISSION RANK |
| 0.35 | 0.065 | 5.384615 | 1 | 2 | 3.5 | 2 |
| 0.35 | 0.05 | 7 | 1 | 2 | 3.5 | 2 |
| 0.4 | 0.05 | 8 | 1 | 2 | 3.5 | 2 |
| 0.45 | 0.04 | 11.25 | 1 | 2 | 3.5 | 2 |
| 0.5 | 0.04 | 12.5 | 1 | 2.5 | 3.5 | 2.5 |
| 0.6 | 0.076 | 7.894737 | 1 | 2.75 | 2 | 2.75 |
| 0.6 | 0.085 | 7.058824 | 1 | 2.75 | 2 | 2.75 |

IMAGE FORMING APPARATUS INCLUDING AN ELECTRIC FIELD HAVING AN OSCILLATION COMPONENT BETWEEN AN IMAGE CARRIER AND A DEVELOPER CARRIER

BACKGROUND OF THE INVENTION

The present invention relates to an image forming apparatus of the type developing a latent image formed on an image carrier with a developer, which forms a magnet brush on a developer carrier.

Generally, a copier, printer facsimile apparatus or similar electrophotographic or electrostatic image forming apparatus includes an image carrier implemented as a photoconductive drum or a photoconductive belt. A latent image is formed on the image carrier in accordance with image data. A developing device develops the latent image with toner to thereby produce a corresponding toner image. Today, magnet brush type development using a two-ingredient type developer, i.e., a toner and carrier mixture is predominant over development using a one-ingredient type developer, i.e., toner only. Magnet brush type development is desirable in the aspect of image transfer, reproduction of halftone, stable development against varying temperature and humidity, and so forth. The toner and carrier mixture rises on a developer carrier in the form of brush chains and feeds the toner to a latent image formed on the image carrier in a developing region. The developing region refers to a range over which the magnet brush on the developer carrier contacts the image carrier.

The developer carrier is made up of a sleeve or developing sleeve, which is usually cylindrical, and a magnet roller accommodated in the sleeve. The magnet roller forms an electric field that causes the developer deposited on the sleeve to rise in the form a magnet brush. The carrier of the developer rises on the sleeve in the form of chains along the magnetic lines of force issuing from the magnet roller. The toner, which is charged to preselected polarity, deposits on the carrier forming the chains. The magnet roller has a plurality of magnetic poles each being formed by a particular rod-like or similar magnet. Among the poles, a main pole is positioned on the surface of the sleeve in the developing region for causing the developer to rise. At least one of the sleeve and magnet roller moves relative to the other so as to cause the developer forming the magnet brush on the sleeve to move.

The developer brought to the developing region rises in the form of chains along magnetic lines of force issuing from the main pole of the magnet roller. The chains contact the surface of the image carrier while yielding. The chains feed the toner to the latent image while rubbing themselves against the latent image on the basis of a difference in linear velocity between the developer carrier and the image carrier.

The developer carrier and image carrier are spaced from each other by a preselected development gap at a position where they are closest to each other. When the development gap is increased, the force of the magnet brush rubbing itself against the image carrier decreases. This successfully reduces the omission of the trailing edge of a toner image and faithfully reproduces horizontal lines. However, an increase in development aggravates a so-called edge effect, i.e., increases the amount of toner to deposit on the edges of a latent image, resulting in so-called edge enhancement. Specifically, the edge effect develops solitary dots in a size larger than expected, thickens lines, enhances the contour of a solid image portion and that of a halftone image portion, and causes areas around such image portions to be lost. Consequently, sophisticated control is required over the reproduction of tonality.

By reducing the development gap, it is possible to reduce the edge effect during development and therefore to produce an image with a minimum of granularity. A decrease in development gap, however, intensifies the force of the magnet brush acting on the image carrier. This, coupled with the influence of inverse charge deposited on the carrier, causes the trailing edge of an image to be lost and degrades the reproducibility of horizontal lines and dots. The resulting image is noticeably dependent on direction.

Japanese patent application Nos. 11-39198, 11-128654 and 11-155378, for example, each disclose an image forming apparatus constructed to reduce the omission of the trailing edge of an image even if the image has low contrast. There is, however, an increasing demand for an image forming apparatus capable of implementing further improved image density and image quality.

Technologies relating to the present invention are also disclosed in, e.g., Japanese patent laid-open publication Nos. 8-36303, 10-39620 and 2000-305360 and Japanese Patent 2,941,884.

SUMMARY OF THE INVENTION

It is an object of the present invention to provide an image forming apparatus capable of freeing an image from granularity and the omission of a trailing edge.

It is another object of the present invention to provide an image forming apparatus capable of obviating granularity in a halftone or low-density image portion to thereby further enhance image quality.

An image forming apparatus of the present invention develops a latent image formed on an image carrier with a developer that forms a magnet brush on a developer carrier. The developer carrier is made up of a sleeve and a stationary magnet roller accommodated in the sleeve. The magnet roller includes a main pole for causing the developer to form the magnet brush and auxiliary poles for helping the main pole exert a magnetic force. An electric field including an oscillation component is formed between the image carrier and the developer carrier.

A particular ratio is set up between a distance between the image carrier and the developer carrier, as measured at the boundary of a nip, and the shortest distance between them, between the above shortest distance and the shortest distance between the developer carrier and a metering member, or between the shortest distance between the image carrier and the developer carrier and the amount of developer scooped up to the image carrier.

BRIEF DESCRIPTION OF THE DRAWINGS

The above and other objects, features and advantages of the present invention will become more apparent from the following detailed description taken with the accompanying drawings in which:

FIG. 11 is a table listing the results of experiments conducted with the illustrative embodiment for estimating the omission of the trailing edge of an image and granularity;

FIG. 12 is a table showing a relation between AC frequency, which is applied as a bias, and granularity determined by experiments;

FIG. 13 is a table showing a relation between a duty ratio and granularity also determined by experiments; and FIGS. 14 through 17 are tables each showing a particular relation between a development gap and a doctor gap and the granularity of a halftone image also determined by experiments.

DESCRIPTION OF THE PREFERRED EMBODIMENTS

Preferred embodiments of the image forming apparatus in accordance with the present invention will be described hereinafter.

Figure 1:
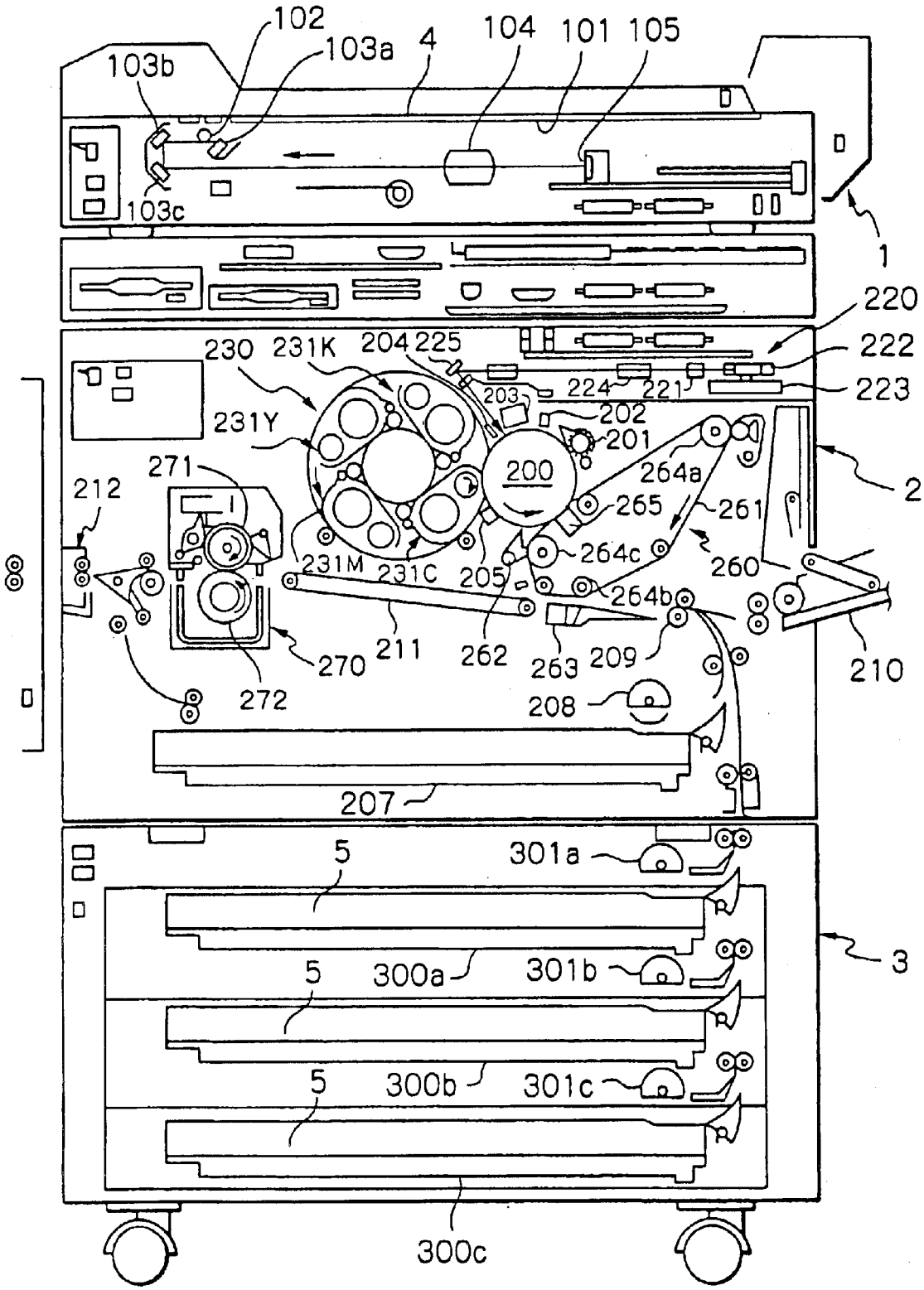
FIG. 1 is a front view showing an image forming apparatus embodying the present invention.

Referring to FIG. 1 of the drawings, an image forming apparatus embodying the present invention is shown and implemented as an electrophotographic color copier by way of example. As shown, the color copier is generally made up of a color scanner or color image reading device 1, a color printer or color image recording device 2, a sheet bank 3, and a control system that will be described later.

The color scanner 1 includes a lamp 102 for illuminating a document 4 laid on a glass platen 101. The resulting reflection from the document 4 is incident to a color image sensor 105 via mirrors 103*a*, 103*b* and 103*c* and a lens 104. The color image sensor 105 reads color image information incident thereto color by color, e.g., red (R), green (G) and blue (B) image information while converting each of them to an electric signal. In the illustrative embodiment, the color image sensor 105 includes R, G and B color separating means and a CCD (Charge Coupled Device) array or similar photoelectric transducer. An image processing section, not shown, transforms the resulting R, G and B image signals to black (Bk), cyan (C), magenta (M) and yellow (Y) color image data in accordance with the intensity of the signal.

More specifically, in response to a scanner start signal synchronous to the operation of the color printer 2, which will be described later, the optics including the lamp 102 and mirrors 103*a* through 103*c* scans the document 4 in a direction indicated by an arrow in FIG. 1. The color scanner 1 outputs image data of one color every time it scans the document 4, i.e., outputs image data of four different colors by scanning the document 4 four consecutive times. The color printer 2 sequentially forms Bk, C, M and Y toner images while superposing them on each other, thereby completing a four-color or full-color toner image.

The color printer 2 includes a photoconductive drum or image carrier 200, an optical writing unit 220 and a revolver or developing device 230. The color printer 2 further includes an intermediate image transferring unit 260 and a fixing unit 270. The drum 200 is rotatable counterclockwise, as indicated by an arrow in FIG. 1. Arranged around the drum 200 are a drum cleaner 201, a discharge lamp 202, a charger 203, a potential sensor or charged potential sensing means 204, one of developing sections of the revolver 230 selected, a density pattern sensor 205, and a belt 261 included in the intermediate image transferring unit 260.

The optical writing unit 220 converts the color image data output from the color scanner 1 to a corresponding optical signal and scans the surface of the drum 4 in accordance with the optical signal. As a result, a latent image is electrostatically formed on the drum 200. The optical writing unit 220 includes a semiconductor laser or light source 221, a laser driver, not shown, a polygonal mirror 222, a motor 223 for driving the mirror 222, an f/θ lens 224, and a mirror 225.

The revolver 230 includes a Bk developing section 231K, a C developing section 231C, a M developing section 231M, a Y developing section 231Y, and a drive arrangement for causing the revolver 230 to bodily rotate counterclockwise, as indicated by an arrow in FIG. 1. The developing sections 231K through 231Y each include a developing sleeve and a paddle or agitator. The developing sleeve rotates with a developer forming a magnet brush thereon and contacting the surface of the drum 200 to thereby develop the latent image. The paddle scoops up the developer to the developing sleeve while agitating it. In the illustrative embodiment, the developer stored in each developing section is a toner and carrier mixture, i.e., a two-ingredient type developer. The toner is charged to negative polarity by being agitated together with the carrier. A bias power supply or bias applying means applies a bias for development to the developing sleeve. Consequently, the developing sleeve biases a metallic core layer included in the drum 200 to a preselected potential. In the illustrative embodiment, the above bias is implemented by a negative DC voltage Vdc biased by an AC voltage Vac.

While the color copier is in a standby state, the revolver 230 remains stationary with the Bk developing unit 231K facing the drum 200 at a developing position. On the start of a copying operation, the color scanner 1 starts reading Bk color image information at a preselected timing. A laser beam issuing from the semiconductor laser 221 starts forming a Bk latent image in accordance with Bk color image data derived from the Bk color image information. The Bk developing sleeve included in the Bk developing unit 231K starts rotating before the leading edge of the Bk latent image arrives at the developing position. As a result, Bk latent image is developed by Bk toner from the leading edge to the trailing edge. As soon as the trailing edge of the Bk latent image moves away from the developing position, the revolver 230 bodily rotates to bring the next developing section to the developing position. This rotation completes at least before the leading edge of the next latent image arrives at the developing position. The configuration and operation of the revolver 230 will be described more specifically later.

The intermediate image transferring unit 260 includes a belt cleaner 262 and a corona discharger 263 in addition to the previously mentioned belt 261. The belt 261 is passed over a drive roller 264*a*, a roller 264*b* located at an image transferring position, a roller 264*c* located at a cleaning position, and driven rollers. A motor, not shown, causes the belt 261 to turn. In the illustrative embodiment, the belt 261 is formed of ETFE (Ethylene TetraFluoroEthylene) and has electric resistance of $10^8$ Ω/cm$^2$ to $10^{10}$ Ω/cm$^2$ in terms of surface resistance. The belt cleaner 262 includes an inlet seal, a rubber blade, a discharge coil, and a mechanism for moving the inlet seal and rubber blade, although not shown specifically. While the transfer of images of the second to fourth colors from the drum 200 to the belt 261 is under way after the transfer of the image of the first color or Bk, the above mechanism maintains the inlet seal and rubber blade spaced from the belt 261. A DC voltage or an AC biased DC voltage is applied to the corona discharger 263. The corona discharger 263 collectively transfers the full-color image completed on the belt 261 to a paper sheet or similar recording medium.

The color printer 2 includes a sheet cassette 207 in addition to the sheet bank 3, which includes sheet cassettes 300*a*, 300*b* and 300*c*. The sheet cassettes 207 and 300*a* through 300*c* each are loaded with a stack of paper sheets 5 of a particular size. Pickup rollers 208 and 301*a*, 301*b* and 301*c* are respectively associated with the sheet cassettes 207 and 300*a*, 300*b* and 300*c*. One of the pickup rollers 208 through 301*c* pays out the sheets from associated one of the sheet cassettes 207 through 300*c* selected toward a registration roller pair 209. A manual feed tray 210 is available for feeding OHP (OverHead Projector) sheets, thick sheets and other special sheets by hand.

In operation, on the start of an image forming cycle, the drum 200 rotates counterclockwise while the belt 261 turns counterclockwise by being driven by the previously mentioned motor. In this condition, a Bk, a C, a M and a Y toner image are sequentially transferred from the drum 200 to the belt 261 one above the other, completing a full-color image.

More specifically, the charger 203 uniformly charges the surface of the drum 200 to a negative potential of about −700 V by corona discharge. The semiconductor laser 221 scans the charged surface of the drum 200 by raster scanning in accordance with a Bk color image signal. As a result, the charge of the drum 200 is lost in the scanned portion in proportion to the quantity of incident light, forming a Bk latent image. Bk toner charged to negative polarity and forming a magnet brush on the Bk developing sleeve contacts the Bk latent image. At this instant, the Bk toner deposits only on the scanned portion of the drum 200 where the charge is lost, thereby forming a Bk toner image. An image transferring device 265 transfers the Bk toner image from the drum 200 to the belt 261, which is turning in contact with and at the same speed as the drum 200. Let the image transfer from the drum 200 to the belt 261 be referred to as primary image transfer.

The drum cleaner 201 removes some Bk toner left on the drum 200 after the primary image transfer to thereby prepare the drum 200 for the next image formation. The toner removed by the drum cleaner 201 is collected in a waste toner tank via a piping, although not shown specifically.

The color scanner 1 starts reading C image data at a preselected timing. A C latent image is formed on the drum 200 in accordance with the C image data. After the trailing edge of the Bk latent image has moved away from the developing position, but before the leading edge of the C latent image arrives at the developing position, the revolver 230 rotates to bring the C developing section 231C to the developing position. The C developing section 231C develops the C latent image with C toner for thereby producing a corresponding C toner image. After the trailing edge of the C latent image has moved away from the developing position, the revolver 230 again rotates to bring the M developing section 231M to the developing position. This rotation also completes before the leading edge of the next or M latent image arrives at the developing position.

The formation of a M toner image and a Y toner image will not be described specifically because it is similar to the formation of the Bk and C toner images described above.

By the above procedure, the Bk, C, M and Y toner images are sequentially transferred from the drum 200 to the belt 261 one above the other. The corona discharger 263 collectively transfers the resulting full-color toner image from the belt 261 to the paper sheet 5. The transfer of the full-color toner image from the belt 261 to the paper sheet 5 will be referred to as secondary image transfer hereinafter.

More specifically, the paper sheet 5 is fed from any one of the sheet cassettes 207 and 300*a* through 300*c* or the manual feed tray 210 and once stopped by the registration roller pair 209. The registration roller pair 209 drives the paper sheet 5 at such a timing that the leading edge of the paper sheet 5 meets the trailing edge of the full-color toner image formed on the belt 261. The corona discharger 263 charges the paper sheet 5, which is superposed on the full-color toner image, to positive polarity. As a result, the toner image is almost entirely transferred from the belt 261 to the paper sheet 5. A discharger, not shown, located at the left-hand-side of the corona discharger 263 discharges the paper sheet 5 by AC+DC corona discharge, so that the paper sheet 5 is separated from the belt 261. The paper sheet 5 is then transferred to a conveyor 211 implemented as a belt.

The conveyor 211 conveys the paper sheet 5 carrying the toner image thereon to the fixing unit 270. In the fixing unit 270, a heat roller 271 and a press roller 272 cooperate to fix the toner image on the paper sheet 5 with heat and pressure. The paper sheet or full-color copy 5 coming out of the fixing unit 270 is driven out to a copy tray, not shown, face up.

After the secondary image transfer, the drum cleaner 201, which may be implemented as a brush roller or a rubber blade, cleans the surface of the drum 200. Subsequently, the discharge lamp 202 uniformly discharges the surface of the drum 200. At the same time, the inlet seal and rubber blade of the belt cleaner 262 are again pressed against the belt 261 to thereby clean the surface of the belt 261.

In a repeat copy mode, after the formation of the first Y toner image on the drum 200, the color scanner and drum 200 are operated to form the second Bk toner image. On the other hand, after the secondary transfer of the first full-color image from the belt 261 to the paper sheet 5, the second Bk toner image is transferred to the area of the belt 261 that has been cleaned by the belt cleaner 262.

In a bicolor or a tricolor copy mode, as distinguished from the above-described full-color copy mode, the same procedure is repeated a number of times corresponding to desired colors and a desired number of copies. Further, in a monocolor copy mode, one of the developing sections of the revolver 230 corresponding to a desired color is held at the developing position until a desired number of copies have been output. At the same time, the inlet seal and blade of the belt cleaner 262 are constantly held in contact with the belt 261.

Assume that the full-color copy mode operation is effected with paper sheets of size A3. Then, it is desirable to form a toner image of one color every time the belt 261 makes one turn and therefore to complete a full-color image by four turns of the belt 261. More preferably, however, a toner image of one color should be formed during two turns of the belt 261. This makes the entire copier small size, i.e., reduces the circumferential length of the belt 261 and guarantees a copy speed for relatively small sheet sizes while preventing the copy speed from decreasing for the maximum sheet sizes. In such a case, after the transfer of the Bk toner image from the drum 200 to the belt 261, the belt 261 makes one idle turn without any development or image transfer. During the next turn of the belt 261, the next or C toner image is formed and transferred to the belt 261. This is also true with the M and Y toner images. The revolver 230 is caused to rotate during the idle turn of the belt 261.

Figure 2:
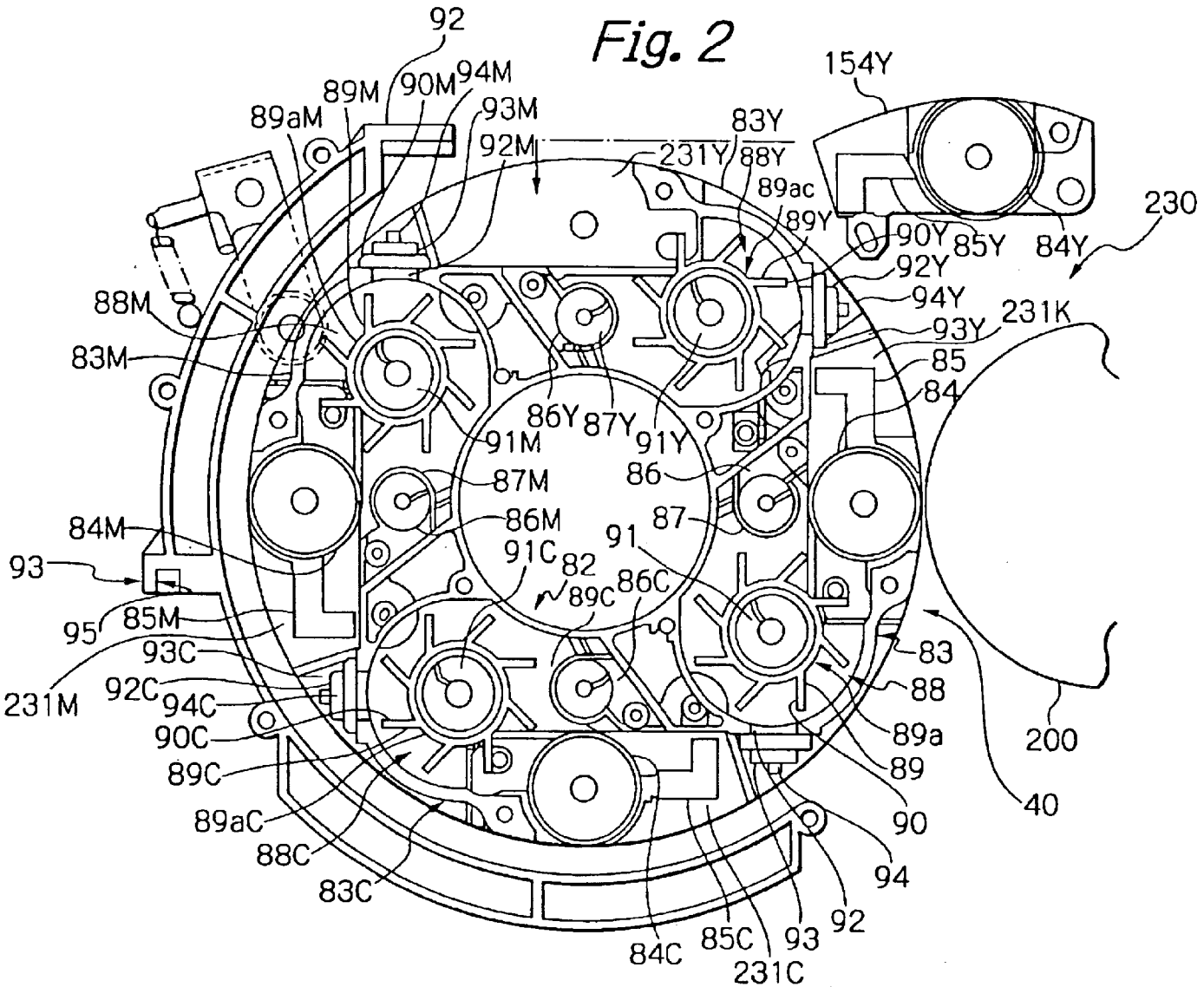
FIG. 2 is a section showing a revolver or developing device included in the illustrative embodiment.

Reference will be made to FIG. 2 for describing the revolver 230 in detail. As shown, the revolver 230 includes a developing unit 40 including the developing sections 231K through 231Y. The developing unit 40 includes a pair of disk-like end walls and a partition wall supported by the end walls at opposite ends thereof. The partition wall includes a hollow, cylindrical portion 82 and four casing portions 83, 83C, 83M and 83Y extending radially outward from the cylindrical portion 82. The casing portions 83 through 83Y divide the space around the cylindrical portion 82 into four developing chambers, which are substantially identical in configuration, in the circumferential direction. The developing chambers each store the developer, i.e., toner and carrier mixture of a particular color. In the specific position shown in FIG. 2, the developing chamber of the Bk developing section 231K, which stores the black toner and carrier mixture, is located at the developing position. This developing chamber is followed by the developing chambers of the Y developing section 231Y, M developing section 231M, and C developing section 231C in the counterclockwise direction.

The following description will concentrate on the black developing chamber located at the developing position by way of example. In FIG. 2, the yellow, magenta and cyan developing chambers are simply distinguished from the black developing chamber by suffixes Y, M and C.

In the Bk developing section 231K, the casing portion 83 is formed with an opening facing the drum 200. A developing roller or developer carrier 84 is made up of the developing sleeve and a magnet roller disposed in the developing sleeve. A doctor blade or metering member 85 regulates the amount of the developer deposited on and conveyed by the developing roller 84 to the developing position. An upper screw conveyor 86 conveys part of the developer removed by the doctor blade 85 from the rear to the front in the direction perpendicular to the sheet surface of FIG. 2. A guide 87 guides the screw conveyor 86. A paddle or agitator 88 agitates the developer stored in the developing chamber. The paddle 88 includes a hollow, cylindrical portion 89 formed with a plurality of holes 89*a* at spaced locations in the axial direction of the developing roller 84, and a plurality of blades 90 extending radially outward from the cylindrical portion 89. A lower screw conveyor 91 is disposed in the cylindrical portion 89 and extends in the axial direction of the paddle 88. The lower screw conveyor 91 conveys the developer in the opposite direction to the upper screw conveyor 86. The casing portion 83 is additionally formed with a slot 92 below the lower screw conveyor 91. The slot 92 extends in the axial direction of the developing unit 40 and may be used to discharge the developer deteriorated or to charge a fresh developer, as desired. A cap 93 is fastened to the casing portion 83 by, e.g., screws 94.

In the illustrative embodiment, the drum 200 has a diameter of 90 mm and moves at a linear velocity of 200 mm/sec. The developing sleeve, i.e., the developing roller 84 has a diameter of 30 mm and moves at a linear velocity of 260 mm/sec, which is 2.5 times as high as the linear velocity of the drum 1. A development gap between the drum 200 and the developing roller 84 is 0.35 mm or 0.4 mm. The magnet roller disposed in the developing roller 84 causes the developer deposited on the roller 84 to rise in the form of a magnet brush. More specifically, the carrier of the developer rises in the form of chains on the developing roller 84 along magnetic lines of force issuing from the magnet roller. The charged toner deposit on the carrier to thereby form a magnet brush.

Figure 4:
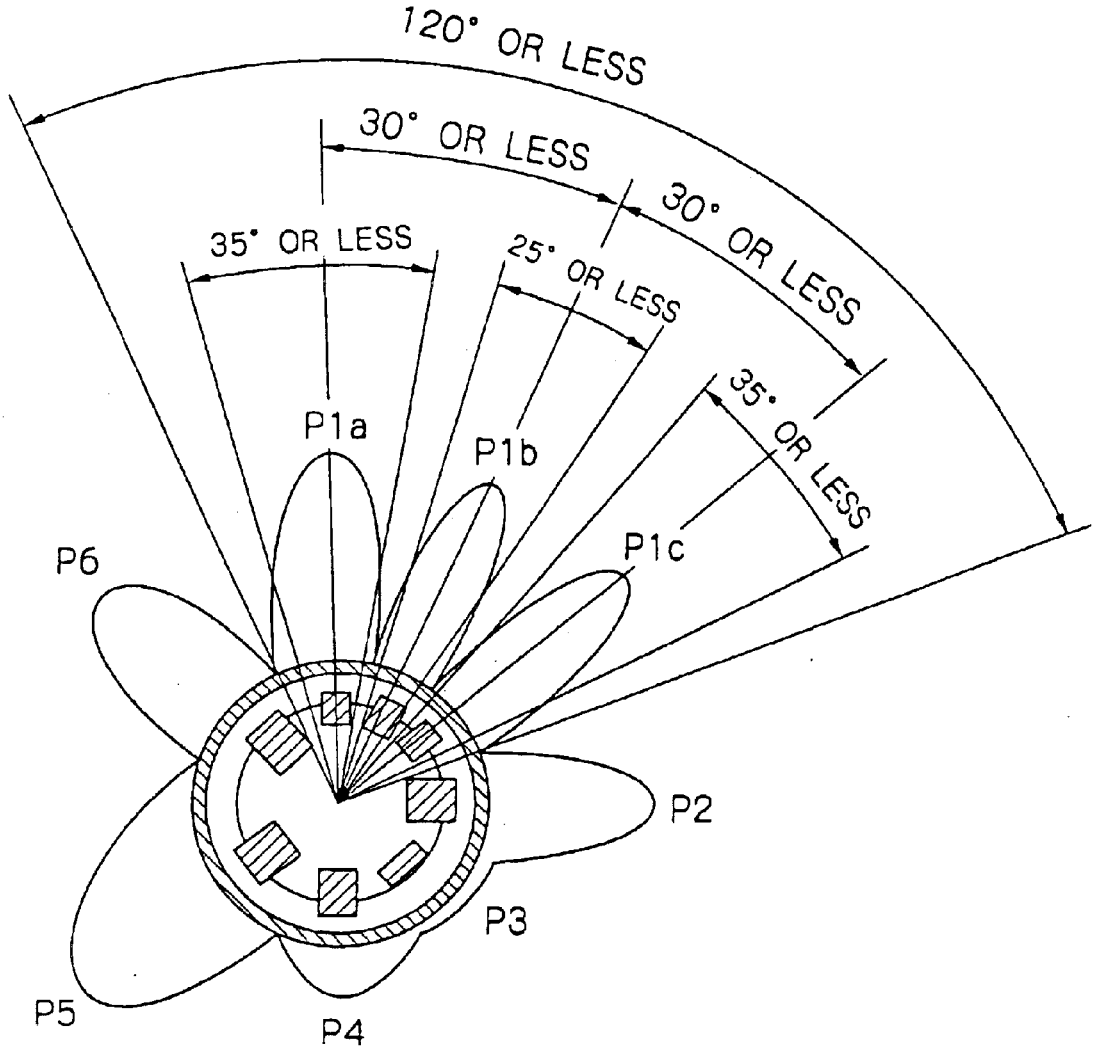
FIG. 4 is a view showing a positional relation between a main pole and auxiliary poles included in the magnet roller.

As shown in FIG. 4, The magnet roller has a plurality of magnetic poles or magnets P1*a* through P1*c* and P2 through P6. The pole or main pole P1*b* causes the developer to rise in a developing region where the sleeve developing roller 84 and drum 200 face each other. The poles P1*a* and P1*c* help the main pole P1*b* exert such a magnetic force. The pole P4 scoops up the developer to the developing sleeve. The poles P5 and P6 convey the developer to the developing region. The poles P2 and P3 convey the developer in a region following the developing region. All of the poles of the magnet roller are oriented in the radial direction of the developing sleeve. While the magnet roller is shown as having eight poles, additional poles may be arranged between the pole P3 and the doctor blade 85 in order to enhance the scoop-up of the developer and the ability to follow a black solid image. For example, two to four additional poles may be arranged between the pole P3 and the doctor blade 85.

The poles P1*a* through P1*c* are sequentially arranged from the upstream side to the downstream side in the direction of developer conveyance, and each is implemented by a magnet having a small sectional area. While such magnets are formed of a rate earth metal alloy, they may alternatively be formed of, e.g., a samarium alloy, particularly a samarium-cobalt alloy. An iron-neodium-boron alloy, which is a typical rare earth metal alloy, has the maximum energy product of 358 kJ/m$^3$. An ion-neodium-boron alloy bond, which is another typical rare earth metal, has the maximum energy product of 80 kJ/m$^3$ or so. Such magnets guarantee magnetic forces required of the surface of the developing roller 41 despite their small sectional area. A ferrite magnet and a ferrite bond magnet, which are conventional, respectively have the maximum energy products of about 36 kJ/m$^3$ and 20 kJ/m$^3$. If the sleeve is allowed to have a greater diameter, then use may be made of ferrite magnets or ferrite bond magnets each having a relatively great size or each having a tip tapered toward the developing sleeve in order to reduce a half width.

It is to be noted that a half width refers to the angular width of a portion where the magnetic force is one half of the maximum or peak magnetic force of a magnetic force distribution curve normal to the developing sleeve. For example, if the maximum magnetic force of a N magnet in the normal direction is 120 mT, then the half width (50%) is 60 mT; if the half value is 80%, as also used in the art, then it is 96 mT. The smaller the half width, the closer the position where the magnet brush rises to the main pole, and the narrower the nip for development. The auxiliary pole is formed upstream and/or downstream of the main pole in the direction in which the developer is conveyed.

In the above specific configuration, the main pole P1*b* and poles P4, P6, P2 and P3 are N poles while the poles P1*a*, P1*c* and P5 are S poles. For example, the main magnet P1*b* had a magnetic force of 85 mT or above in the normal direction, as measured on the developing roller. It was experimentally found that if the main pole P1*b* had a magnetic force of 60 mT or above, defects including the deposition of the carrier were obviated. The deposition of the carrier occurred when the above magnetic force was less than 60 mT. The magnets P1*a* through P1*c* each had a width of 2 mm while the magnet P1*b* had a half width of 16°. By further reducing the width of the magnet, the half value was further reduced. A magnet had a half value of 12° when the width was 1.6 mm.

FIG. 4 shows a positional relation between the main magnet P1*b* and the auxiliary magnets P1*a* and P1*c*. As shown, the half width of each of the auxiliary magnets P1*a* and P1*c* is selected to be 35° or below. This half width cannot be reduced relatively because the magnets P2 and P6 positioned outside of the magnets P1*a* and P1*c* have great half widths. The angle between each of the auxiliary magnets P1*a* and P1*c* and the main magnet P1*b* is selected to be 30° or below. More specifically, because the half width of the main pole P1*a* is 16°, the above angle is selected to be 22°. Further, the angle between the transition point (0 mT) between the magnets P1*a* and P6 and the transition point (0 mT) between the magnets P1*c* and P2 is selected to be 120° or below. The transition point refers to a point where the N pole and S pole replace each other.

The drum 200 and developing roller 84 facing each other form a nip for development therebetween. Toner moves between the drum 200 and the magnet. In the case of contact development, the toner moves mainly in the nip or developing region. In the developing region, the size of the electric field differs from the point where the drum 200 and developing roller are closest to each other to the point where they are remotest from each other, i.e., the boundary of the nip. In the illustrative embodiment, the gap between the drum 200 and the developing roller is 0.4 mm or 0.35 mm. When the nip width is varied, the distance between the drum and the developing roller varies at each of the center and the boundary of the nip. Consequently, for a uniform developing layer, the strength of the electric field varies in inverse proportion to the ratio between the drum and the developing roller. Experiments conducted to determine the influence of the above electric field on the omission of a trailing edge will be described later.

To efficiently discharge the deteriorated developer via the slot 92, the following procedure is preferable. First, the developing unit 40 is pulled out of the copier body via a base not shown. Subsequently, an input gear 95 (see FIG. 6A), as well as other gears, is rotated via, e.g., a jig, so that the deteriorated developer is discharged with the upper and lower screw conveyors 86 and 91 and paddle 88 being rotated. Also, a fresh developer may be charged via the slot 92 with the screw conveyors 86 and 91 and paddle 88 being rotated. This allows the fresh developer to be evenly scattered in the existing developer.

Figure 5:
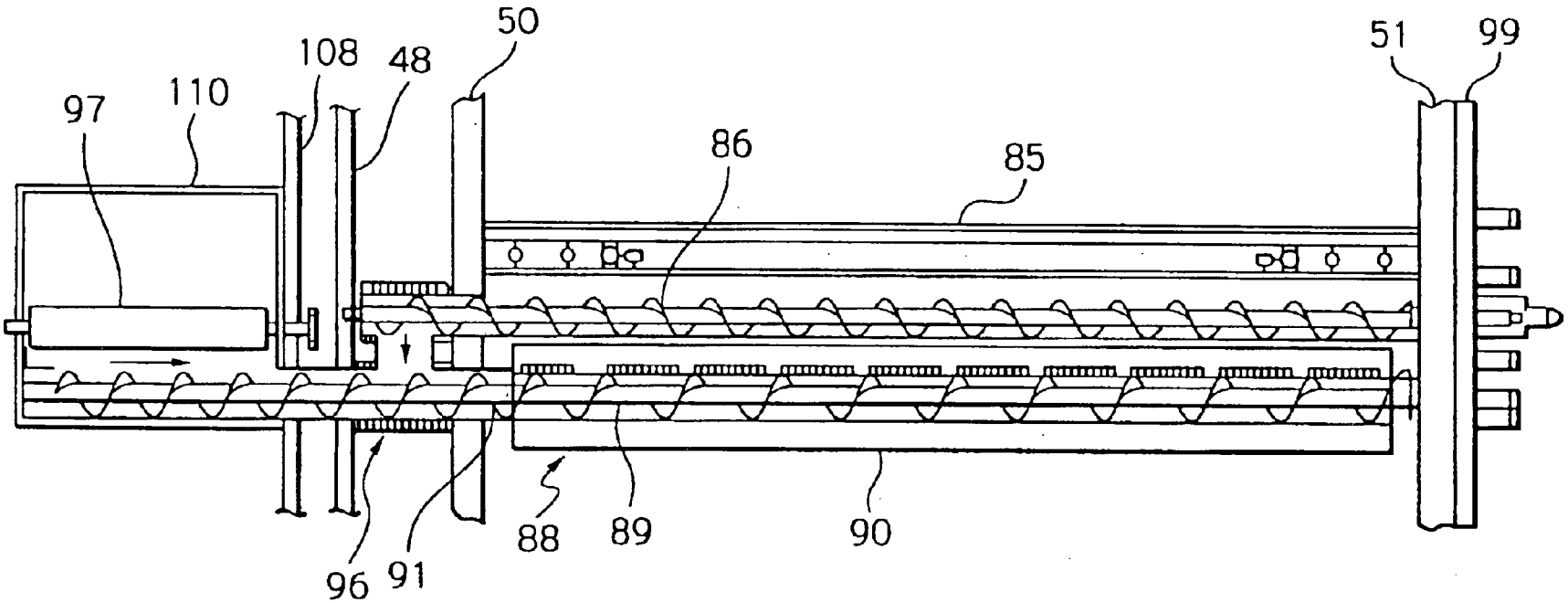
FIG. 5 is a view showing a structure in which a developing section included in the revolver and a toner container are connected to each other.

FIG. 5 is a section showing the black developing section 231K in a plane containing the axes of the upper and lower screw conveyors 86 and 91. As shown, the front ends of the screw conveyors 86 and 91 extend to the outside of the effective axial range of the developing roller 84, i.e., to the outside of the front end wall 50 of the developing unit 40 in the illustrative embodiment. The developer conveyed by the screw conveyor 86 drops onto the screw conveyor 91 via a drop portion 96 due to its own weight.

The front end of the screw conveyor 91 further extends via the drop portion 96 to a communication chamber positioned below a toner replenishing roller 97. The toner replenishing roller 97 is included in a toner storing unit, not shown, assigned to each developing chamber. In this configuration, the developer removed by the doctor blade 85, conveyed by the screw conveyor 86 and then dropped via the drop portion 96 is conveyed by the screw conveyor 91 to the effective axial range of the developing roller 84. The developer is then introduced into the developing chamber via the holes of the hollow, cylindrical portion of the paddle and again deposited on the developing roller 84. That is, the developer is agitated in the horizontal direction in the developing chamber. The paddle 88 in rotation agitates the above developer introduced into the developing chamber with its blades in the vertical direction.

Further, the toner replenishing roller 97 in rotation causes fresh toner to drop onto part of the screw conveyor 91 existing in the communication chamber. The screw conveyor 91 conveys the fresh toner to the drop portion 96. As a result, the fresh toner is mixed with the developer dropped from the screw conveyor 86 and then fed to the developing chamber via the holes of the cylindrical portion of the paddle, increasing the toner content of the developer.

Figure 6A:
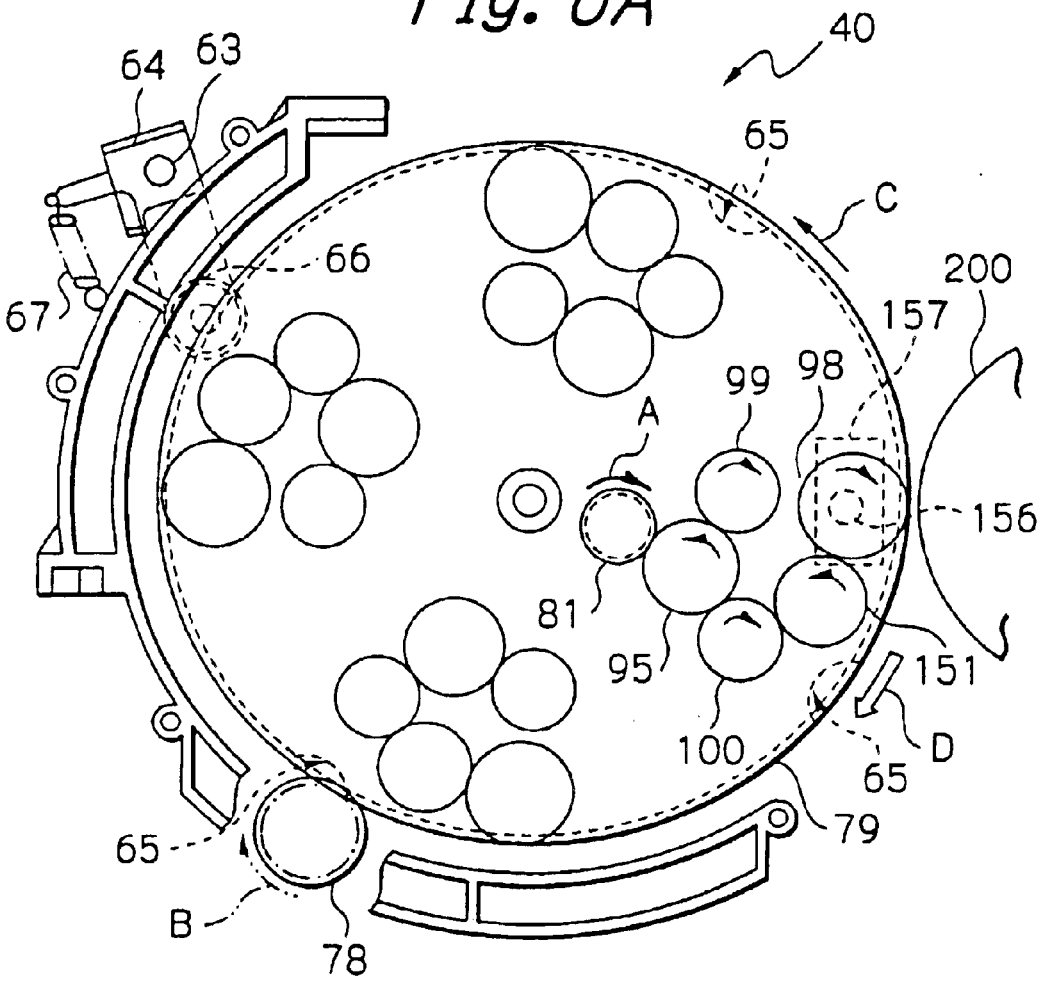
FIG. 6A is a perspective front view showing a mechanism for driving the revolver.

FIG. 6A is a perspective view of the rear end wall 51 of the developing unit 40 as seen from the front. As shown, a revolver input gear 79 is affixed to the rear end wall 51. Various gears shown in FIG. 6A are positioned at the rear of the revolver input gear 79. Specifically, the shaft of the developing roller 84 extends throughout the rear end wall 51 to a position rearward of the revolver input gear 79. A developing roller gear 98 is mounted on the rear end of the shaft of the developing roller 84. Likewise, the shafts of the upper and lower screw conveyors 86 and 91 extend throughout the end wall 51 to a position rearward of the revolver input gear 79. An upper and a lower screw gear 99 and 100 are mounted on the rear ends of the screw conveyors 86 and 91, respectively. An idle gear 151 and a development input gear 95 are mounted on the back of the rear end wall 51. The idle gear 151 is held in mesh with the developing roller gear 98 and lower screw gear 100. The development input gear 95 is capable of meshing with a development output gear 81, which is mounted on a rear side wall 51 included in the copier body. A motor 80 causes the development output gear 81 to rotate. As shown in FIG. 6A, when the developing unit 40 is mounted to the previously mentioned base and then inserted into the copier body, the development input gear 95 is brought into mesh with the development output gear 81. At the same time, the revolver input gear 79 is brought into mesh with the revolver output gear 78.

Figure 7A:
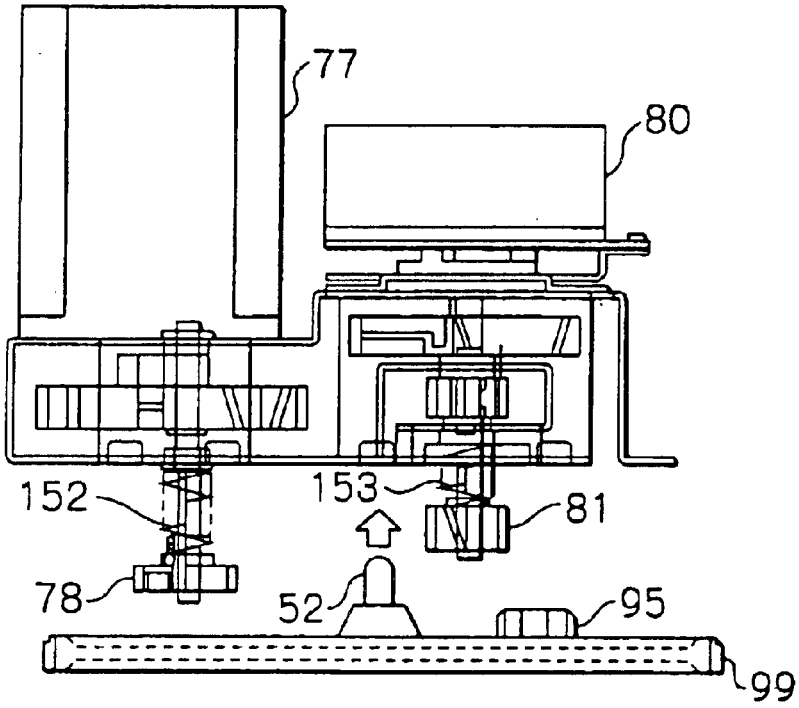
FIG. 7A is a plan view showing a motor for driving the revolver.
Figure 7B:
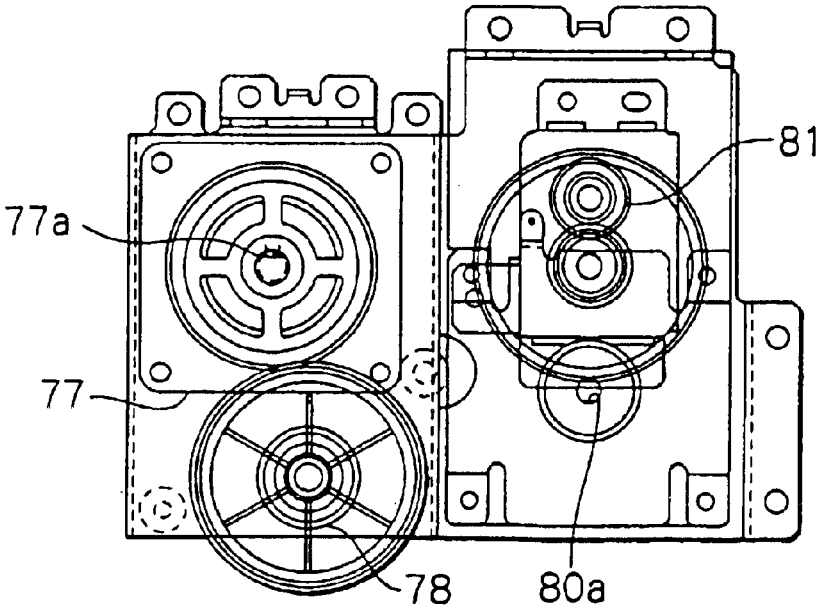
FIG. 7B is a front view of the motor.

As shown in FIGS. 7A and 7B, the revolver output gear 78 and development output gear 81 are mounted on the copier body in such a manner as to be retractable in the direction in which the base slides. Springs 152 and 153 constantly bias the gears 78 and 81 forward in the above direction. It follows that even when the gears 78 and 81 interfere with the gears 79 and 95 of the developing unit 40 when the base is inserted into the printer body, the gears 78 and 81 retract and guarantee the complete insertion of the base. Also, when the gears 78 and 81 are driven, they do not interfere with the gears 79 and 95. Subsequently, the gears 78 and 81 move toward the developing unit 40 due to the action of the springs 152 and 153 and therefore accurately mesh with the gears 79 and 95, respectively, as shown in FIG. 6A.

In the condition shown in FIG. 6A, the development output gear 81 is driven in a direction indicated by an arrow A. The gear 81, in turn, causes the upper and lower screw gears 99 and 100 to rotate via the development input gear 95, thereby causing the upper and lower screw conveyors 86 and 91 to rotate. At the same time, the developing roller gear 98 is rotated via the lower screw gear 100 and idle gear 151 with the result that the developing roller 84 rotates.

In the illustrative embodiment, when the developing unit 40 brings its desired developing section to the developing position, the gear 95 of the developing unit 40 surely meshes with the gear 81 of the copier body before the developer on the developing roller 84 contacts the drum 200. Further, when the developing unit moves the above developing section away from the developing position, the gear 95 surely remains in mesh with the gear 81 until the developer on the developing roller 84 fully moves away from the drum 200. To realize such arrangements, the illustrative embodiment causes the gear 95 to mesh with the gear 81 at a position close to the axis of the developing unit 40.

A revolver motor 77, FIGS. 7A and 7B, causes the revolver output gear 78 to rotate in a direction indicated by an arrow B in FIG. 6A. The revolver motor 77 may be implemented as a stepping motor by way of example. The revolver output gear 78, in turn, rotates the developing unit 40 in a direction indicated by an arrow C in order to bring a desired developing section to the developing position. At the same time, a positioning roller 66 enters one of recesses 65 formed in the circumference of the rear end wall 51 at preselected locations, thereby positioning the developing unit 40. This kind of scheme, however, has the following problem. Assume that the rotation angle of the developing unit 40 is short of a preselected angle due to irregularity in the revolver motor 77 or irregularity in the load of the developing unit 40. Then, the positioning roller 66 fails to enter the expected recess 65, i.e., to accurately position the developing unit 40. The resulting distance between the developing roller 84 and the drum 200 differs from a preselected distance. The preselected angle mentioned above is 90° in the case of the developing section located just upstream of the developing position.

In light of the above, in the illustrative embodiment, the rotation of the revolver motor 77 is controlled by a control value corresponding to an angle slightly greater than the preselected angle, e.g., by 3°. At the same time, even when the developing unit 40 actually rotates by more than the preselected angle due to such control, the developing unit 40 is accurately positioned on the basis of the moment of rotation to act on the unit 40 on the start of drive of the motor 77. Specifically, as shown in FIG. 6A, the development output gear 81 meshing with the development input gear 95, which is included in the developing section located at the developing position, is rotated in the direction A as during ordinary development. The rotation of the development output gear 81 applies a moment of rotation to the developing unit 40 in a direction indicated by an outline arrow D, which is opposite to the ordinary direction of rotation. Further, an arrangement is made such that the developing unit 40 stops rotating in the direction D and is locked in position when the positioning roller 66 has entered the expected recess 65. Specifically, the positioning roller 66 is mounted on a bracket 64 that is, in turn, supported by a positioning pin 63. The positioning pin 63 is positioned such that the bracket 64 is counter to the above rotation of the developing unit 40 as to direction.

Figure 6B:
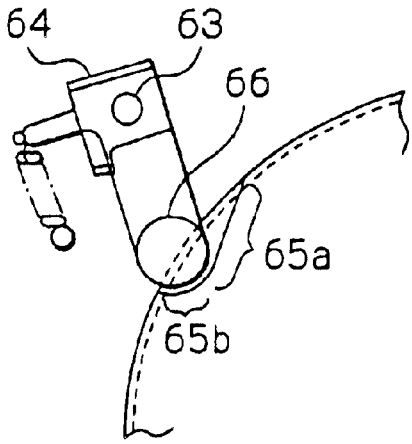
FIG. 6B is a view showing a mechanism for positioning the revolver.

Moreover, as shown in FIG. 6B, each recess 65 should preferably be made up of a portion 65*a* via which the positioning roller 66 leaves the recess 65 during ordinary rotation and a portion 65*b* for locking the developing unit 40. The portion 65*a* is inclined less than the portion 65*b*. Assume that the positioning roller 66 enters the recess 65 and then leaves it due to the rotation of the developing unit 40 exceeding the preselected angle. Then, the portion 65*a* allows the positioning roller 66 to smoothly leave the recess 65 and thereby reduces a load on the drive mechanism.

In the specific arrangement shown in FIG. 2, part of the front end wall and part of the rear end wall supporting the developing roller 84Y and doctor blade 85Y are implemented as small wall members 154Y separable from the other portions of the end walls. This configuration applies to the other developing sections as well. In the event of cleaning of the developing chamber or the replacement of parts, the wall members 154Y supporting the developing roller 84Y and doctor blade 85Y are removed in order to promote easy access to the inside of the developing chamber.

Figure 6C:
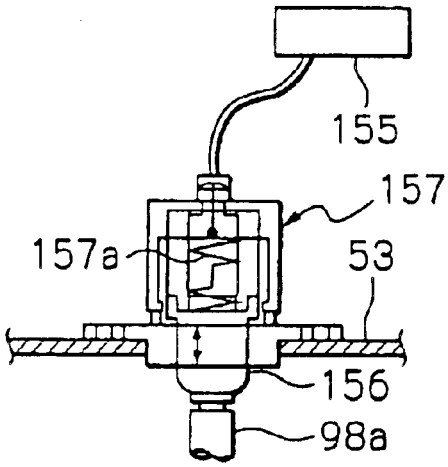
FIG. 6C is a view showing a device for applying a bias for development to the revolver.

As shown in FIG. 6C, a bracket 157 is mounted on the rear side wall 53 of the copier body and supports a conductive, rod-like terminal 156. The terminal 156 is so positioned as to face the end of a shaft 98*a* on which the developing roller 84 of the developing section located at the developing position is mounted. The terminal 156 is connected to a bias power supply 155 for development and retractable in the direction in which the previously stated base is slidable (direction of thrust). A conductive spring or biasing means 157*a* constantly biases the terminal 156 forward toward the copier body. The end of the terminal 156 is convex in a hemispherical configuration while the end of the shaft 98*a* is concave in a hemispherical configuration. The concave end of the shaft 98*a* has a slightly greater radius of curvature than the convex end of the terminal 156. This successfully reduces a load when the end of the shaft 98*a* arrive at or leaves the end of the terminal 156, and allows the former to remain in stable contact with the latter. The terminal 156 applies the bias for development only to the developing section located at the developing position in the same manner as during development. When the developing section is brought to the developing position, the end of the shaft 98*a* surely contacts the end of the terminal 156 before the developer on the developing roller 84 contacts the drum 200. Also, when the developing section leaves the developing position, the end of the shaft 98*a* surely remains in contact with the end of the terminal 156 until the developer fully parts from the drum 200.

Figure 8:
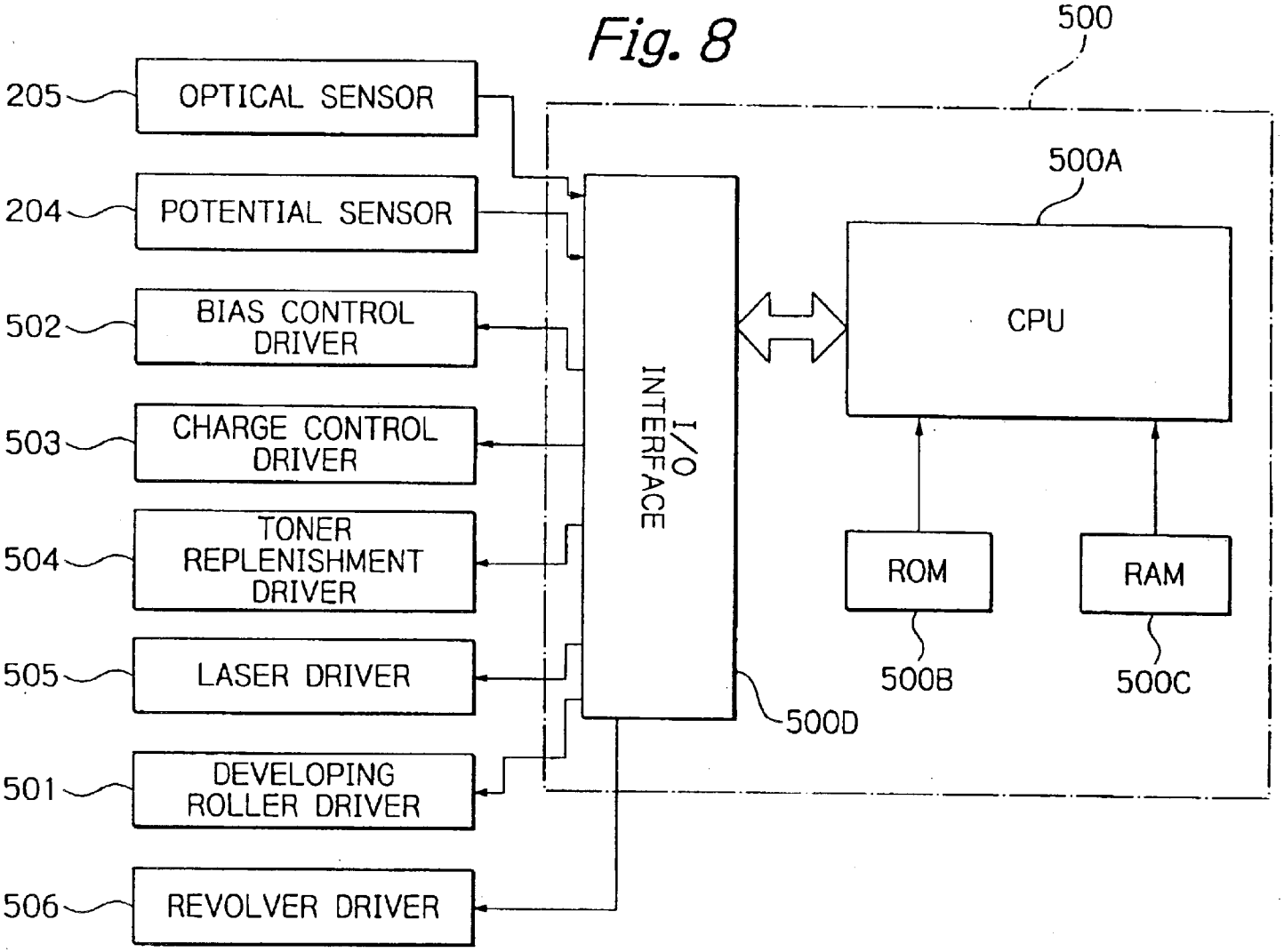
FIG. 8 is a schematic block diagram showing a control system included in the illustrative embodiment.

FIG. 8 shows a control system included in the illustrative embodiment. As shown, the control system includes a controller 500. The controller 500 includes a CPU (Central Processing Unit) 500A, a ROM (Read Only Memory) 500B connected to the CPU 500A, and a RAM (Random Access Memory) also connected to the CPU 500A. The ROM 500B stores a basic program and basic data for executing the program. The RAM 500C stores various kinds of interim data. The potential sensor 204 and density pattern sensor 205 are connected to the CPU 500A via an I/O (Input/Output) interface 500D. The density pattern sensor 205 is made up of a light emitting element and a light-sensitive element. The potential sensor 204 senses the potential of the drum 200 at a position upstream of the developing position. Also connected to the CPU 500A via the I/O interface 500D are a developing roller driver 501, a bias control driver or bias switching means 502, a charge control driver or charge potential switching means 503, a toner replenishment driver 504, a laser driver 505, and a revolver driver 506.

The bias control driver 502 causes an AC-biased DC voltage for development to be applied to the rod-like terminal 156. The bias control driver 502 is capable of selectively applying or stopping applying the AC voltage independently of the DC voltage in accordance with a control signal output from the controller 500. In addition, the bias control driver 502 is capable of varying the DC voltage at a preselected timing in accordance with a control signal also output from the controller 500.

The charge control driver 503 is connected to the charger 203 in order to apply a bias to the charger 203. The charge control driver 503 is capable of varying the above bias at a preselected timing in accordance with a control signal output from the controller 500.

The present invention is applicable to an electrophotographic, monochromatic copier, as will be described hereinafter. The monochromatic copier to be described includes a scanner similar to the color scanner except that it reads monochromatic image information. Further, the monochromatic copier is substantially identical with the color copier as to the sheet bank and control system. The following description will therefore concentrate on the image forming section.

Figure 9:
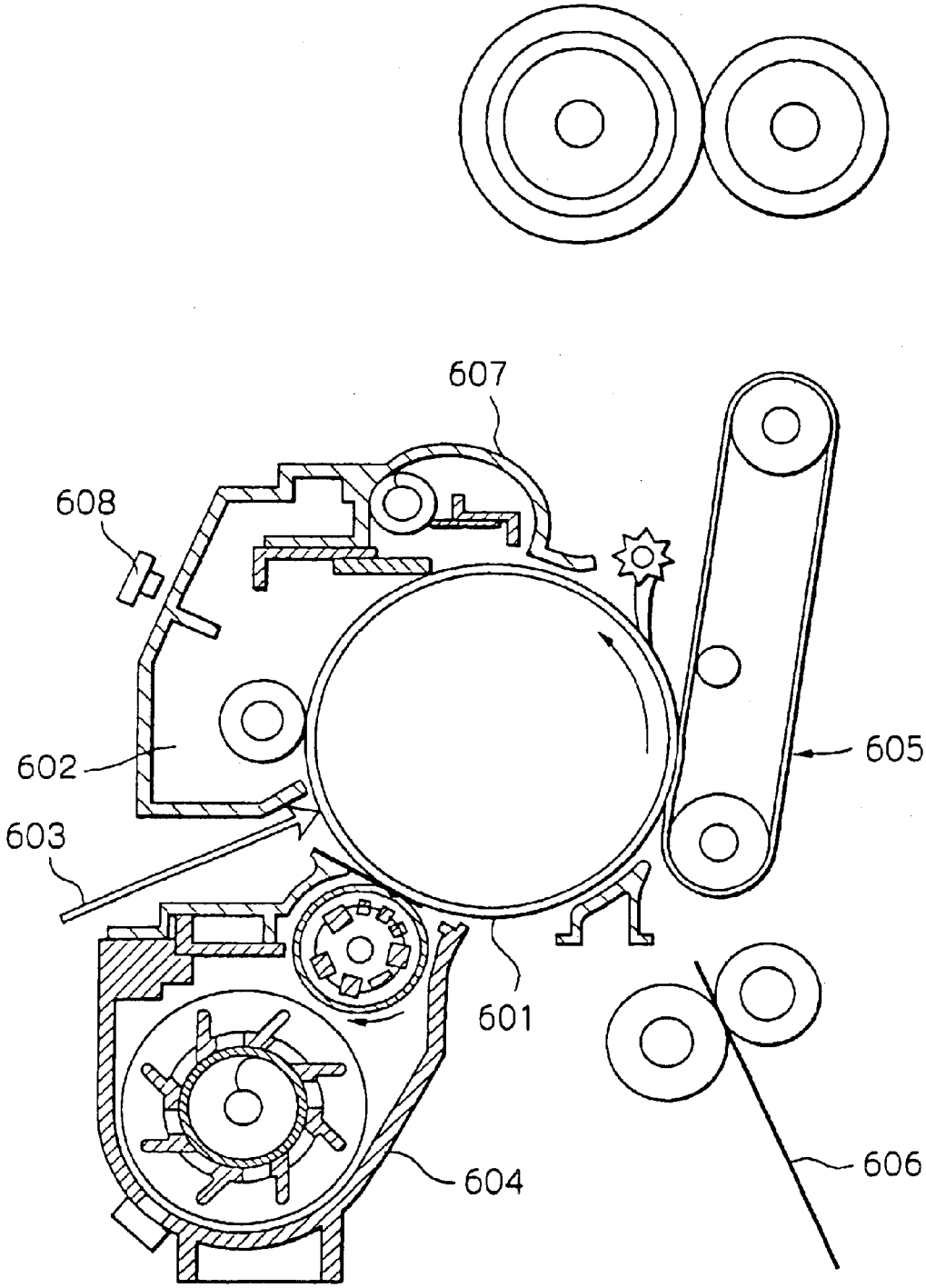
FIG. 9 is a view showing a drum unit included in a monochromatic copier to which the illustrative embodiment is applied.

As shown in FIG. 9, the monochromatic copier includes a photoconductive drum 601, which is a specific form of an image carrier, rotatable in a direction indicated by an arrow (counterclockwise). A charger 602 uniformly charges the surface of the drum 601 to a preselected potential. An exposing unit 603 exposes the charged surface of the drum 601 with a laser beam in accordance with image data to thereby form a latent image. A developing device 604 develops the latent image with toner for producing a corresponding toner image. The developing device 604 includes a casing and a developing sleeve or developer carrier. An image transferring unit 605 transfers the toner image from the drum 601 to a paper sheet or similar recording medium 606. A drum cleaner 607 removes toner left on the drum 601 after the image transfer. Further, a discharger 608 discharges the surface of the drum 601 to thereby prepare the drum 601 for the next image formation.

In operation, the charger 602 uniformly charges the surface of the drum 601 with a charge roller. The exposing unit 603 scans the charged surface of the drum 601 to thereby form a latent image. The developing unit 604 develops the latent image with toner. The image transferring unit 605, which includes a belt, transfers the resulting toner image from the drum 601 to the paper sheet 606 fed from a tray not shown. A peeler peels off the paper sheet 606 electrostatically adhering to the drum 601. A fixing unit fixes the toner image transferred to the paper sheet 606. The drum cleaner 607 removes the toner left on the drum 605 after the image transfer and collects the toner. The discharge lamp 608 discharges the surface of the drum 601.

Figure 10:
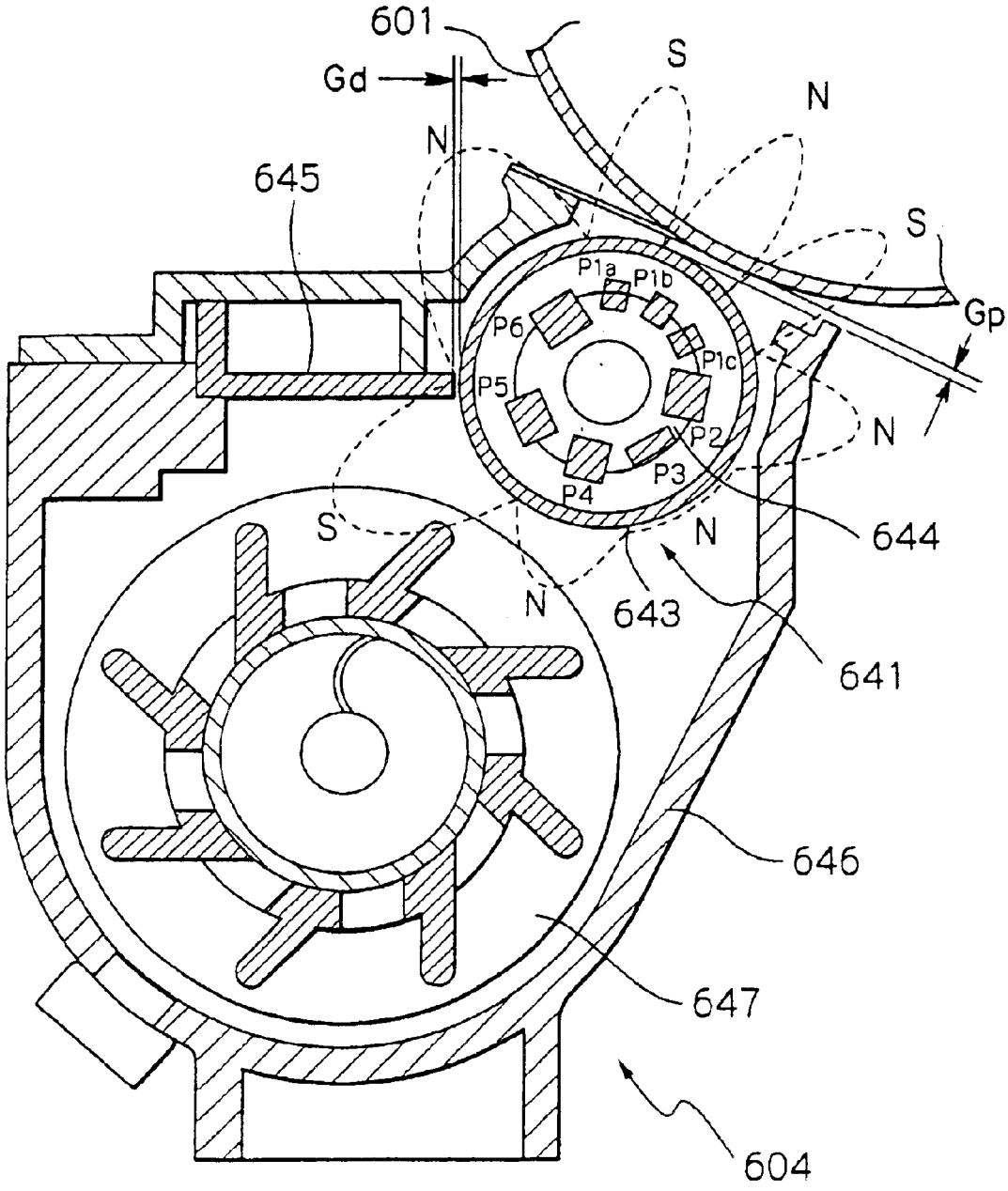
FIG. 10 is an enlarged view showing a developing device also included in the monochromatic copier.

FIG. 10 shows a specific configuration of the developing device 604. As shown, the developing device 604 includes a developing roller 641 adjoining the drum 601. A nip or developing region is formed between the developing roller 641 and the drum 601. The developing roller 641 includes a cylindrical sleeve 643 formed of aluminum, brass, stainless steel, conductive resin or similar nonmagnetic material. A drive mechanism, not shown, causes the sleeve 643 to rotate clockwise, as viewed in FIG. 10, or in a direction of developer conveyance. In the illustrative embodiment, the drum 601 has a diameter of 30 mm to 60 mm and rotates at a linear velocity of 240 mm/sec. The developing sleeve 643 has a diameter of 16 mm to 20 mm and rotates at a linear velocity of 600 mm/sec. A ratio of the drum linear velocity to the sleeve linear velocity is therefore 2.5. A developing gap between the drum 601 and the developing sleeve 643 is selected to be 0.4 mm.

A doctor blade or metering member 645 is positioned upstream of the developing region in the direction of developer conveyance (clockwise as viewed in FIG. 10). The doctor blade 645 regulates the amount of the developer to be conveyed by the developing sleeve 643 to the developing region, i.e., the height of a magnet brush. A doctor gap between the doctor blade 645 and the sleeve 643 is selected to be 0.4 mm. A screw 647 is positioned at the opposite side to the drum 601 with respect to the developing roller 641. The screw 647 scoops up the developer stored in a casing 646 to the developing roller 641 while agitating it.

Figure 3:
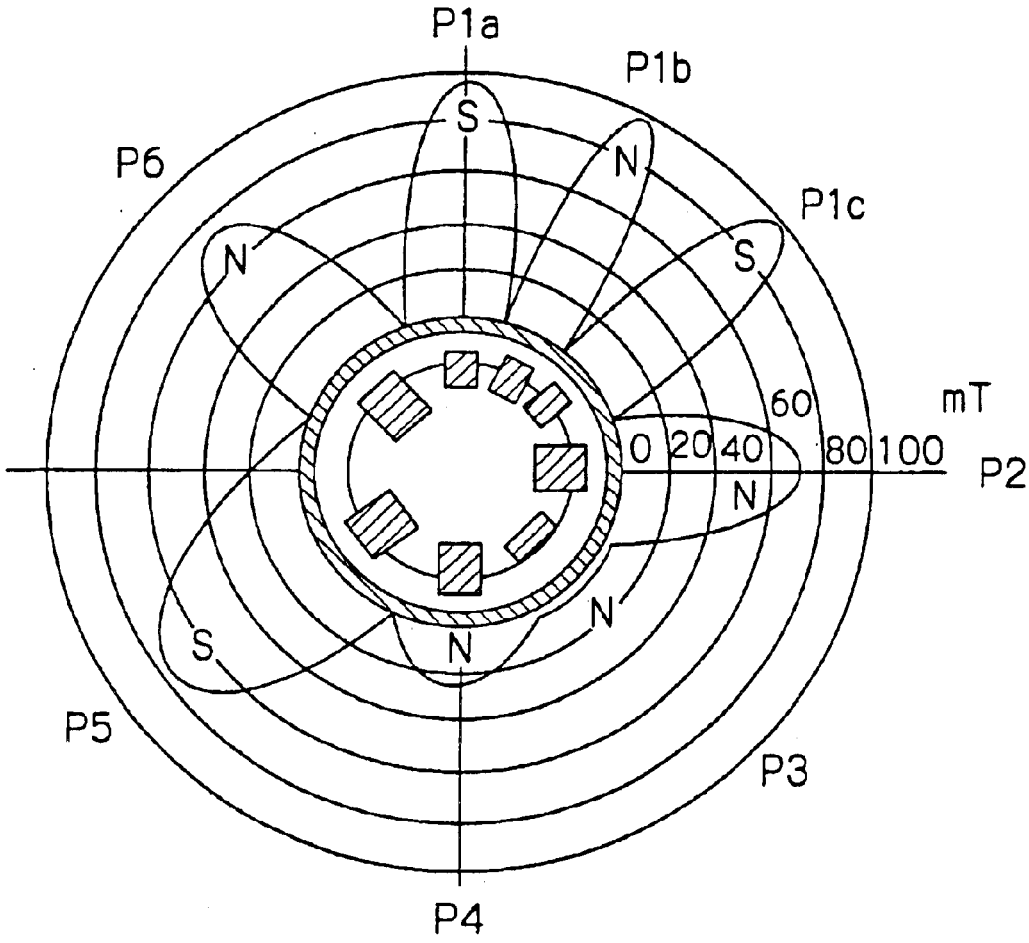
FIG. 3 is a chart showing the distribution and sizes of the magnetic forces of a magnet roller included in the revolver.

A magnet roller 644 is held stationary within the sleeve 643 for causing the developer to form a magnet brush on the sleeve 643. The magnet roller 644 has the configuration described previously with reference to FIGS. 3 and 4. A relation between the nip width and the omission of the trailing edge of an image and granularity will be described hereinafter.

FIG. 11 shows Experiments No. 1 through No. 10 conducted with the color copier and monochromatic color copier in order to estimate the omission of the trailing edge of an image and granularity. To measure a nip width, while the drum and developing sleeve were held stationary, a bias for causing the toner to migrate from the sleeve toward the drum was applied. In this condition, the range of the drum over which the toner deposited on the drum was measured as a nip. The distance at the boundary of the nip was determined by calculation using the drum diameter, sleeve diameter, development gap, and development nip. As for the trailing edge omission rank, rank 5 indicates that no omission was observed while rank 1 indicates that omission was most conspicuous. Also, as for the granularity rank, rank 5 indicates that no granularity was observed while rank 1 indicates that granularity was most conspicuous. Ranks 4 and above are desirable as to image quality.

As FIG. 11 indicates, when the ratio of the distance at the boundary of the nip to the development gap is 1.5 or less, an image free from the omission of a trailing edge is achievable. This condition, however, could not reduce granularity alone when the bias for development was implemented only by DC. When AC was superposed on DC under the conditions *1 described in Experiment No. 5, granularity was improved with the omission level being maintained. On the other hand, when the ratio of the distance at the boundary to the development gap was greater than 1.5, more specifically 1.97, even AC superposed on DC could not implement the desirable granularity level although somewhat improving it, compared to DC.

It has been known that AC-biased DC improves the granularity level more than DC, as will be seen by comparing Experiments No. 5 and No. 6. However, in a conventional magnet roller or developing roller (half width of 48°), a magnet brush has a great height or length while a nip width for development is great. Therefore, even after the magnet brush has formed a toner image with a minimum of granularity because of AC-biased DC, the brush remains in contact with a photoconductive element over a substantial period of time. As a result, the magnet brush removes toner from the toner image due to physical contact and electrostatically attracts the toner toward a carrier carrying no toner, disturbing the toner image and thereby rendering it granular. In the illustrative embodiment, the auxiliary poles adjoining the main pole, which is closest to the photoconductive element or image carrier, help the main pole exert a magnetic force. This reduces the half width to 25° or below and reduces the nip width. In this condition, the duration of contact of the magnet brush with the photoconductive element after the formation of the above toner image is reduced. Consequently, the toner image suffers from a minimum of disturbance, compared to the conventional toner image.

Experiment No. 8 shown in FIG. 11 was conducted except that a bias of DC −500 V was replaced with AC having various frequencies. Specifically, Experiment No. 8 was conducted under the following conditions:

color copier drum linear velocity: 200 mm/sec sleeve linear velocity: 260 mm/sec drum diameter: 90 mm sleeve diameter: 30 mm development gap: 0.4 mm nip: 4 mm distance at nip boundary: 0.58 mm ratio of distance at nip boundary to nip: 1.13 bias for development fixed conditions: rectangular wave, duty of 50%, peak-to-peak voltage of 800 V, offset voltage of −500 V variable condition: frequencies of 0 kHz to 0.9 kHz FIG. 12 shows the results of the above experiment. As shown, AC reduced granularity although to some different degrees. Specifically, when the nip width is 4 mm and the drum linear velocity is 200 mm/sec, oscillation occurs ten times (0.5 kHz), twenty times (1 kHz), forty times (2 kHz) or 180 times (9 kHz) within the nip width. Further, when the nip width is 2 mm and the drum linear velocity is 230 mm/sec, oscillation occurs four point four times (0.5 kHz), eight point seven times (1 kHz), seventeen point four times (2 kHz) or seventy point three times (9 kHz) within the nip width. It will therefore be seen that when an oscillation component occurs ten times or more before a given point on the drum moves away from the brush contact region, granularity is successfully reduced, and a desirable granularity level is achieved when it occurs thirty times or more.

The above experiment was repeated except that the bias was varied to provide the oscillation component of the electric field with an asymmetric, rectangular waveform. Specifically, the fixed conditions of the bias were a peak-to-peak voltage of 800 V and a frequency of 4.5 kHz while the variable condition was duties of 10% to 60%. A particular offset voltage is assigned to each duty in order to implement an effective value of −500 V. A duty ratio is expressed as:

$$\text{duty ratio}=a/100(a+b)\ (\%)$$

where a denotes the duration of a bias applied to the developing roller or the developing sleeve for causing toner to move toward the drum, and b denotes the duration of a bias applied to the developing roller for causing toner to move toward the sleeve. FIG. 13 shows a relation between the duty ratio and granularity determined by the experiment. As shown, a desirable granularity level is achievable when the oscillation component of the electric field has an asymmetric, rectangular waveform so configured as to reduce the period of time over which toner moves toward the drum.

As stated above, in the illustrative embodiment, the ratio of the distance between the image carrier and the developer carrier, as measured at the boundary of the nip, to the shortest distance between them is selected to be 1.5 or below. Further, an electric field including an oscillation component is formed between the image carrier and the developer carrier. This is successful to satisfy both of granularity and the omission of a trailing. Granularity can be further reduced if the oscillation component is provided with an optimal frequency. This is also true when the waveform of the oscillation component is provided with an optimal value.

An alternative embodiment of the present invention will be described hereinafter. This embodiment is also practicable with the configuration of the color copier described with reference to FIGS. 1 through 8. Assume that the color copier shown in FIG. 1 forms a development gap Gp between the drum 200 and the developing sleeve of the developing section located at the developing position, and forms a doctor gap Gd between the doctor blade of the above developing section and the developing sleeve. In the illustrative embodiment, experiments were conducted to estimate granularity and the omission of a trailing edge by varying the development gap Gp and doctor gap Gd.

As for image forming conditions, there were selected a ratio of the sleeve linear velocity to the drum linear velocity of 1.3, drum diameter of 90 mm, sleeve diameter of 30 mm, charge potential of −700 V, and bias of DC −500 V having a frequency of 4.5 kHz, an offset voltage of −500 V, a duty ratio of 50% and a peak voltage of 800 V, as stated earlier.

FIG. 14 shows granularity and the omission of the trailing edge of a halftone image estimated by varying the development gap Gp between 0.35 and 0.6 and varying the doctor gap Gd. As for granularity, the quantity of writing light was varied to form solid patterns of 256 different tones (sized 2 cm×2 cm) and then developed. The halftone portions of the resulting toner images having lightness of 50 degrees to 80 degrees were observed by eye. In FIG. 14, granularity rank 5 indicates that granularity was not observed at all, while rank 1 indicates that granularity was most conspicuous. As for the omission of a trailing edge, the trailing edges of the above toner images were observed by eye; rank 5 indicates that no omission was observed, while rank 1 indicates that omission was most conspicuous. Ranks 4 and above are good, rank 3 is average, and ranks 2 and below are no good.

DC did not noticeably improve image quality when the ratio Gp/Gd was low. By contrast, when AC was superposed on DC under the conditions shown in FIG. 14, the granularity level was more improved with a decrease in ratio Gp/Gd. As for the omission of a trailing edge, attractive images were produced under any one of the above conditions. This is accounted for by the following presumable occurrences. When the ratio Gp/Gd is low, the developer scooped by the scooping pole and moved away from the doctor blade enters the development gap smaller than the doctor gap. Therefore, when the developer arrives at the developing position, it is packed more densely between the drum and the developing sleeve than when it is scooped up. Further, because the distribution of the magnetic force of the main pole is narrower than the convention distribution, a dense magnet brush is formed within the narrow nip width. This increases the probability that the developer contacts the drum within the nip width, and further promotes efficient migration of charge from the developing sleeve toward the drum. In this manner, the developer densely packed at the developing position effectively reduces granularity. Experiments showed that the ratio Gp/Gd should be smaller than at least 0.8.

FIG. 15 lists the results of comparative experiments similar to the experiments of FIG. 14, but conducted with a conventional magnet roller lacking auxiliary poles and having a main pole whose half width is about 48°. As shown, although AC replacing DC reduces granularity, no correlation exists between the ratio Gp/Gd and the granularity rank. Granularity decreases with a decrease in the development gap Gp, but the omission of a trailing edge is aggravated. No condition that satisfies both of the granularity level and omission level does not exist in the comparative experiments. Specifically, in the comparative experiments, the great half width increases the length of the magnet brush in the circumferential direction of the developing roller and thereby increases the width over which the magnet brush contacts the drum (nip width). A greater nip width directly translates into a longer period of time over which the magnet brush remains in contact with the drum. Such a period of time, in turn, increases the probability that the toner once deposited on the drum migrates toward the developing roller and therefore results in the omission of a trailing edge, as well known in the art.

In the comparative experiments, too, when the ratio Gp/Gd is low, the developer scooped by the scooping pole and moved away from the doctor blade enters the development gap smaller than the doctor gap. Therefore, when the developer arrives at the developing position, it is presumably packed more densely between the drum and the developing sleeve than when it is scooped up. Further, because the distribution of the magnetic force of the main pole is narrower than the convention distribution, a dense magnet brush is presumably formed within the narrow nip width. This increases the probability that the developer contacts the drum within the nip width, and further promotes efficient migration of charge from the developing sleeve toward the drum. However, the probability that toner once deposited on the drum migrates toward the developing roller increases for the same reason as discussed in relation to the omission of a trailing edge. As a result, despite that a toner image free from granularity is formed on the drum, the toner presumably again deposits on the magnet brush.

Experiments were conducted with the same color copier by varying the AC frequency and yielded results listed in FIG. 15. Specifically, the experiments were conducted under the following conditions:

drum linear velocity: 200 mm/sec sleeve linear velocity: 260 mm/sec drum diameter: 90 mm sleeve diameter: 30 mm development gap: 0.4 mm doctor gap: 4 mm bias for development fixed conditions: rectangular wave, duty of 50%, peak-to-peak voltage of 800 V, offset voltage of −500 V variable condition: frequencies of 0 kHz to 0.9 kHz FIG. 15 shows the results of the above experiment as to granularity. As shown, AC reduced granularity although to some different degrees. Specifically, when the nip width is 4 mm and the drum linear velocity is 200 mm/sec, oscillation occurs ten times (0.5 kHz), twenty times (1 kHz), forty times (2 kHz) or 180 times (9 kHz) within the nip width. Further, when the nip width is 2 mm and the drum linear velocity is 230 mm/sec, oscillation occurs four point four times (0.5 kHz), four point seven times (1 kHz), seventeen point four times (2 kHz) or seventy-eight point three times (9 kHz) within the nip width. It will therefore be seen that when an oscillation component occurs ten times or more before a given point on the drum moves away from the brush contact region, granularity is successfully reduced, and a desirable granularity level is achieved when it occurs thirty times or more.

The above experiment was repeated except that the bias was varied to provide the oscillation component of the electric field with an asymmetric, rectangular waveform. Specifically, the fixed conditions of the bias were a peak-to-peak voltage of 800 V and a frequency of 4.5 kHz while the variable condition was a duty of 10% to 60%. A particular offset voltage is assigned to each duty in order to implement an effective value of −500 V. The duty ratio (a/100(a+b) (%)) and granularity were found to have the relation described with reference to FIG. 13. Specifically, a desirable granularity level is achievable when the oscillation component of the electric field has an asymmetric, rectangular waveform so configured as to reduce the period of time over which toner moves toward the drum.

Further, to estimate granularity and the omission of a trailing edge, the development gap Gp between the developing sleeve of the developing section located at the developing position and the drum was varied. Also, the amount p of the developer scooped up to the developing sleeve and then moved away from the doctor blade was varied. As for image forming conditions, use were again made of a sleeve linear velocity/drum linear velocity of 1.3, drum diameter of 90 mm, sleeve diameter of 30 mm, charge potential of −700 V, and bias of DC −500 V having the frequency of 4.5 kHz, offset voltage of −500, duty ratio of 50% and peak voltage 800 V. FIG. 16 lists the granularity of a halftone image and the omission of a trailing edge estimated by varying the development gap Gp between 0.35 and 0.6 and varying the amount p. The omission of a trailing edge was estimated by the same method as applied to the case wherein the gaps Gp and Gd were varied.

DC did not noticeably improve image quality when the ratio Gp/Gd was low. By contrast, when AC was superposed on DC under the conditions shown in FIG. 16, the granularity level was more improved with a decrease in ratio Gp/Gd. Specifically, the granularity level was improved as the developer is packed more densely in the narrow development gap, i.e., as the magnet brush becomes narrower and more dense. Experiments showed that the ratio Gp/p should be smaller than at least 10.

FIG. 17 lists the results of comparative experiments similar to the experiments of FIG. 16, but conducted with a conventional magnet roller lacking auxiliary poles and having a main pole whose half width is about 48°. Again, when the ratio Gp/p is low, the developer scooped by the scooping pole and moved away from the doctor blade enters the development gap smaller than the doctor gap. Therefore, when the developer arrives at the developing position, it is presumably packed more densely between the drum and the developing sleeve than when it is scooped up. The magnet brush is therefore more dense when the ratio Gp/p is low than when it is high. This increases the probability that the developer contacts the drum within the nip width, and further promotes efficient migration of charge from the developing sleeve toward the drum. However, the probability that toner once deposited on the drum migrates toward the developing roller increases for the same reason as discussed in relation to the omission of a trailing edge. As a result, despite that a toner image free from granularity is formed on the drum, the toner presumably again deposits on the magnet brush.

The frequency of the bias for development was varied with the development gap Gp and amount p being held at 0.35 mm and 0.065 g/cm$^2$, respectively. This also derived the same results as obtained by varying the development gap Gp and amount ρ. This was also true when the oscillation component of the electric field had an asymmetric, rectangular waveform.

As stated above, in the illustrative embodiment, the ratio of the development gap Gp to the doctor gap Gd is selected to be smaller than 0.8, or the ratio of the gap Gp to the amount p of the developer is selected to be smaller than 10. In any case a dense magnet brush is formed at the developing position. Further, an electric field including an oscillation component is formed between the image carrier and the developer carrier. This is successful to satisfy both of granularity and the omission of a trailing edge. Granularity can be further reduced if the oscillation component is provided with an optimal frequency. This is also true when the waveform of the oscillation component is provided with an optimal value.

Various modifications will become possible for those skilled in the art after receiving the teachings of the present disclosure without departing from the scope thereof.

What is claimed is:

1. In an image forming apparatus for forming a magnet brush on a developer carrier and causing said magnet brush to contact a latent image formed on an image carrier to thereby develop said latent image, said developer carrier comprises a sleeve and a stationary magnet roller accommodated in said sleeve, said magnet roller includes a main pole configured to cause the developer to rise in a form of the magnet brush and an auxiliary pole configured to help said main pole exert a magnetic force, a ratio of a distance between said image carrier and said developer carrier, as measured at a boundary of a nip for development, to a shortest distance between said image carrier and said developer carrier is 1.5 or below, and an electric field including an oscillation component is formed between said image carrier and said developer carrier.

2. The apparatus as claimed in claim 1, wherein the oscillation component comprises an asymmetric, rectangular waveform configured to reduce a period of time over which toner contained in the developer migrates toward said image carrier.

3. The apparatus as claimed in claim 2, wherein the oscillation component is configured to oscillate at least ten times before a given point on said image carrier moves away from a range in which the magnet brush remains in contact with said image carrier.

4. The apparatus as claimed in claim 1, wherein the oscillation component is configured to oscillate at least ten times before a given point on said image carrier moves away from a range in which the magnet brush remains in contact with said image carrier.

5. In an image forming apparatus for forming a magnet brush on a developer carrier and causing said magnet brush to contact a latent image formed on an image carrier to thereby develop said latent image, said developer carrier comprises a sleeve and a stationary magnet roller accommodated in said sleeve, said magnet roller includes a main pole configured to cause the developer to rise in a form of the magnet brush and an auxiliary pole configured to help said main pole exert a magnetic force, a ratio of a shortest distance between said image carrier and said developer carrier to a shortest distance between said developer carrier and a metering member, which regulates the developer, is smaller than 0.8, and an electric field including an oscillation component is formed between said image carrier and said developer carrier, wherein the oscillation component is configured to oscillate at least ten times before a given point on said image carrier moves away from a range in which the magnet brush contacts said image carrier.

6. The apparatus as claimed in claim 5, wherein the oscillation component comprises an asymmetric, rectangular waveform configured to reduce a period of time over which toner contained in the developer migrates toward said image carrier.

7. In an image forming apparatus for forming a magnet brush on a developer carrier and causing said magnet brush to contact a latent image formed on an image carrier to thereby develop said latent image, said developer carrier comprises a sleeve and a stationary magnet roller accommodated in said sleeve, said magnet roller includes a main pole configured to cause the developer to rise in a form of the magnet brush and an auxiliary pole configured to help said main pole exert a magnetic force, a ratio of a shortest distance between said image carrier and said developer carrier to an amount of the developer scooped up to said image carrier is smaller than 10 mm/(g/cm$^2$) and an electric field including an oscillation component is formed between said image carrier and said developer carrier, wherein the oscillation component is configured to oscillate at least ten times before a given point on said image carrier moves away from a range in which the magnet brush contacts said image carrier.

8. The apparatus as claimed in claim 7, wherein the oscillation component comprises an asymmetric, rectangular waveform configured to reduce a period of time over which toner contained in the developer migrates toward said image carrier.

* * * * *

UNITED STATES PATENT AND TRADEMARK OFFICE

CERTIFICATE OF CORRECTION

PATENT NO. : 6,823,163 B2
DATED : November 23, 2004
INVENTOR(S) : Sugimoto et al.

It is certified that error appears in the above-identified patent and that said Letters Patent is hereby corrected as shown below:

Title page,
Items [45] and [*] Notice, should read as follows:
-- [45] **Date of Patent: *Nov. 23, 2004**
[*] Notice: Subject to any disclaimer, the term of this patent is extended or adjusted under 35 U.S.C. 154(b) by 20 days.

This Patent is subject to a terminal disclaimer. --

Signed and Sealed this

First Day of February, 2005

JON W. DUDAS
*Director of the United States Patent and Trademark Office*